US010222108B2

(12) United States Patent
Naito et al.

(10) Patent No.: US 10,222,108 B2
(45) Date of Patent: Mar. 5, 2019

(54) AIR CONDITIONER

(71) Applicant: Johnson Controls—Hitachi Air Conditioning Technology (Hong Kong) Limited, Hong Kong (CN)

(72) Inventors: Koji Naito, Tokyo (JP); Kazumoto Urata, Tokyo (JP); Kazuhiko Tani, Tokyo (JP); Hiroaki Kaneko, Tokyo (JP); Mikihito Tokudi, Tokyo (JP); Rei Kasahara, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 233 days.

(21) Appl. No.: 15/117,244

(22) PCT Filed: Mar. 28, 2014

(86) PCT No.: PCT/JP2014/059074

§ 371 (c)(1),
(2) Date: Aug. 8, 2016

(87) PCT Pub. No.: WO2015/145714

PCT Pub. Date: Oct. 1, 2015

(65) Prior Publication Data

US 2017/0010031 A1 Jan. 12, 2017

(51) Int. Cl.

| | |
|---|---|
| ***F24F 11/42*** | (2018.01) |
| ***F25B 47/02*** | (2006.01) |
| *F25B 13/00* | (2006.01) |

(52) U.S. Cl.

CPC ..... *F25B 47/025* (2013.01); *F24F 11/42* (2018.01); *F25B 13/00* (2013.01); *F25B 2313/0294* (2013.01); *F25B 2700/15* (2013.01)

(58) Field of Classification Search

CPC ..... F24F 11/42; F25B 2313/0294; F25B 2700/15

(Continued)

(56) References Cited

U.S. PATENT DOCUMENTS 5,568,732 A * 10/1996 Isshiki ..... F25B 13/00 62/129
5,704,217 A * 1/1998 Itoh ..... B60H 1/3207 236/49.3

(Continued)

FOREIGN PATENT DOCUMENTS

JP 56-94142 A 7/1981
JP 60-144546 A 7/1985

(Continued)

OTHER PUBLICATIONS

Japanese Office Action received in corresponding Japanese Application No. 2016-509794 dated Jun. 27, 2017.

(Continued)

*Primary Examiner* — Henry T Crenshaw
(74) *Attorney, Agent, or Firm* — Mattingly & Malur, PC

(57) ABSTRACT

The air conditioner has: an outdoor heat exchanger that exchanges heat between the air and a refrigerant flowing in the interior of this heat exchanger; an outdoor fan that blows air into the outdoor heat exchanger; an outdoor fan motor that rotationally drives the outdoor fan; an outdoor fan inverter that supplies a desired current to the outdoor fan motor; a current detector that detects the current flowing in the outdoor fan motor; and a control unit that controls the outdoor fan inverter such that the rotational frequency of the outdoor fan motor reaches a target rotational frequency. The control unit starts a defrosting operation of the outdoor heat exchanger on the basis of a detection value from the current detector during the heating operation.

4 Claims, 4 Drawing Sheets

(58) Field of Classification Search
USPC ..... 62/154
See application file for complete search history.

(56) References Cited

U.S. PATENT DOCUMENTS

| | | | | |
|---|---|---|---|---|
| 6,244,057 | B1 * | 6/2001 | Yoshida | F25B 13/00 62/160 |
| 2009/0007577 | A1 * | 1/2009 | Kotani | F25B 49/02 62/177 |
| 2012/0036873 | A1 * | 2/2012 | Bush | F24F 1/06 62/81 |
| 2014/0311172 | A1 * | 10/2014 | Iwasaki | F24F 1/06 62/151 |

FOREIGN PATENT DOCUMENTS

| | | | | |
|---|---|---|---|---|
| JP | 64-046530 | A | | 2/1989 |
| JP | 2003-050066 | A | | 2/2003 |
| JP | 2003050066 | A | * | 2/2003 |
| JP | 2003-269772 | A | | 9/2003 |
| JP | 2003269772 | A | * | 9/2003 |
| JP | 2004-325017 | A | | 11/2004 |
| JP | 2008-275216 | A | | 11/2008 |
| JP | 2010-223494 | A | | 10/2010 |
| JP | 2010223494 | A | * | 10/2010 |
| JP | 2012-193915 | A | | 10/2012 |
| JP | 2012193915 | A | * | 10/2012 |
| JP | 2014-019179 | A1 | | 2/2014 |
| NO | 2013/128897 | A1 | | 9/2013 |

OTHER PUBLICATIONS

International Serach Report of PCT/JP2014/059074 dated Jun. 24, 2014.
Japanese Office Action received in corresponding Japanese Application No. 2016-509794 dated Sep. 26, 2017.
Chinese Office Action received in corresponding Chinese Application No. 201480075056.1 dated May 21, 2018.

* cited by examiner

AIR CONDITIONER

TECHNICAL FIELD

The present invention relates to an air conditioner and particularly, to an air conditioner that measures changes in electric current and electric power supplied to an outdoor fan motor to infer frost formation on a heat exchanger.

BACKGROUND ART

Heretofore, as a method of inferring frost formation on a heat exchanger, there has been known detecting an increase in electric current flowing through an outdoor fan motor to perform a defrosting operation.

PRIOR ART LITERATURE

Patent Literature

Patent Literature 1

Japanese Patent Application Laid-Open No. 60-144546

SUMMARY OF THE INVENTION

Technical Problem

Where the rotational speed of an outdoor fan (hereafter referred to as fan rotational speed) is fixed in a heating operation condition, an electric current flowing through an outdoor fan motor (hereinafter referred to as fan electric current) also increases together with an increase in the amount of frost formation on an outdoor heat exchanger, and thus, it becomes possible to detect the frost formation and to make a defrosting judgment. However, in recent years, with energy-saving capabilities of equipments taken into consideration, it has been requested to control the fan rotational speed properly to meet a load and thereby to decrease the electric power consumption by the outdoor fan motor (hereafter referred to as fan electric power). Since a decrease in the fan rotational speed causes the fan electric current to decrease as well, it becomes unable to detect an increase of electric current caused by frost formation.

Further, in a control wherein the fan rotational speed is regulated by the voltage applied to the outdoor fan motor (hereafter referred to as fan voltage), the fan voltage is lowered to decrease the fan rotational speed. When a constant torque control is performed in this case, the decrease in the fan rotational speed hardly results in the decrease in the fan electric current.

For this reason, an object of the present invention is to be capable of coping with the situation of changes in fan rotational speed in inferring frost formation during a heating operation, wherein the state of frost formation on a heat exchanger can properly be inferred to make a defrosting judgment even under the characteristic that as is the case of a torque constant control of the fan motor, the current value does not correspond to the fan rotational speed.

Solution to Problem

In order to accomplish the foregoing object, the present invention resides in an air conditioner comprising:

an outdoor heat exchanger that performs a heat exchange between refrigerant flowing through an interior thereof and air;

an outdoor fan that sends air to the outdoor heat exchanger;

an outdoor fan motor that drivingly rotates the outdoor fan;

an outdoor fan inverter that makes a desired electric current flow through the outdoor fan motor;

a current detector that detects electric current flowing through the outdoor fan motor; and a control section that controls the outdoor fan inverter so that the rotational speed of the outdoor fan motor becomes a target rotational speed;

wherein the control section starts a defrosting operation of the outdoor heat exchanger based on a detection value of the current detector in a heating operation.

Advantageous Effects of Invention

According to the present invention, it becomes possible to make a defrosting judgment properly even when the fan rotational speed changes. Furthermore, even under the characteristic that as is the case of a torque constant control of the fan motor, the electric current value does not correspond to the fan rotational speed, it becomes possible to infer the state of frost formation on the heat exchanger properly and to make a judgment for defrosting.

Other technical problems, configurations and advantageous effects than those aforementioned will be further clarified in the following description of embodiments.

DESCRIPTION OF EMBODIMENTS

Hereinafter, embodiments of an air conditioner in the present invention will be described with reference to the drawings.

Embodiment 1

Hereinafter, a first embodiment of the air conditioner in the present invention will be described with reference to the drawings.

Figure 1:
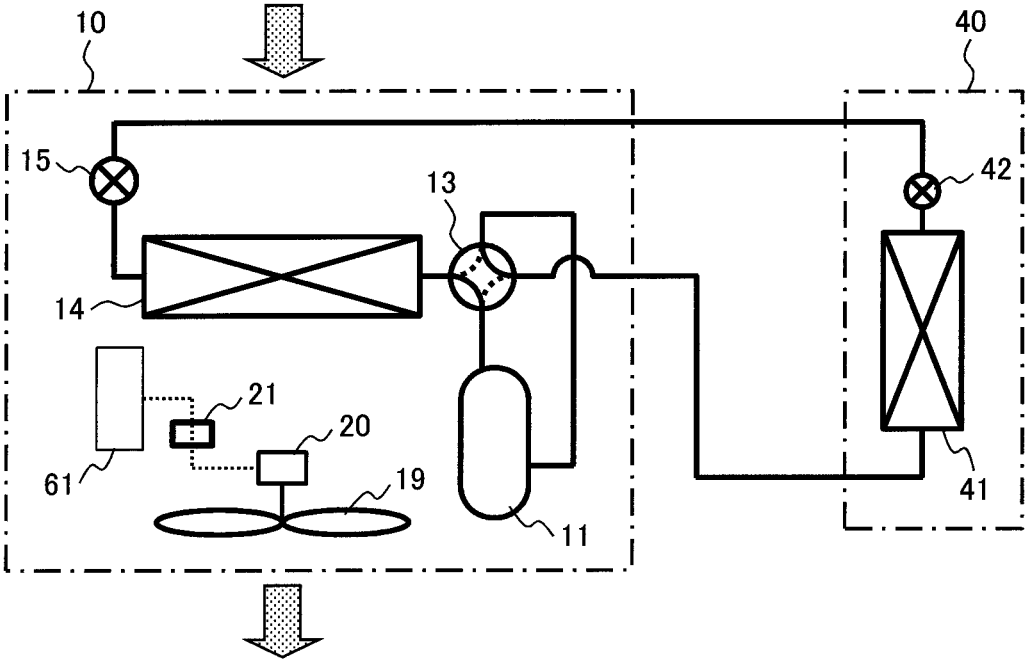
FIG. 1 is a block diagram for a refrigerating cycle in the present invention.

FIG. 1 is a block diagram for a refrigerating cycle in Embodiment 1. Although an example is shown wherein an outdoor unit 10 and an indoor unit 40 are connected in a one-to-one correspondence, the air conditioner may be a multi-type air conditioner connected with a plurality of outdoor units or the outdoor unit may be of the type that a plurality of outdoor units are connected by means of a module connection. First of all, description will be made regarding the flow of refrigerant and a frost formation phenomenon in a heating operation. High-pressure gas refrigerant compressed by a compressor 11 enters a four-way valve 13 and is sent to an indoor unit 40. The refrigerant is subjected by an indoor heat exchanger 41 to heat exchange with indoor air to be condensed to liquid refrigerant. This liquid refrigerant passes through an indoor expansion valve 42 and an outdoor expansion valve 15 to be decompressed and then becomes a low-pressure gas refrigerant as a result of being subjected by an outdoor heat exchanger 14 to heat exchange between the refrigerant flowing through the exchanger interior and outdoor air. This low-pressure gas refrigerant is returned to the compressor 11 through the four-way valve 13 to complete the refrigerating cycle, and the refrigerant is recycled by being compressed by the compressor.

Here, in the outdoor heat exchanger 14, it may occur that when subjected to latent heat exchange in the heat exchange with the outdoor air, water vapor in the atmosphere is solidified on the exchanger's fin surface to turn to droplets. Further, where the evaporating temperature is lower than 0° C., the droplets are subjected to heat exchange on the fins and are solidified to become frost. The frost adhered grows up together with the continuous operation of the air conditioner to make the fins clogged. This causes a drop in the fan air flow rate, a deterioration of a heat transfer coefficient and the like thereby to obstruct the heat exchanger from transferring heat, and hence, it is necessary to perform defrosting.

Next, description will be made regarding the flow of refrigerant and a defrosting phenomenon in a defrosting operation. The defrosting operation in the present embodiment is implemented by changing the four-way valve 13 to the broken-line position contrary to the heating operation, wherein the flow of the refrigerant is in the same direction as that in a cooling operation. The defrosting operation is an operation that is carried out by a so-called reverse cycle. The high-pressure gas refrigerant compressed by the compressor 11 enters the four-way valve 13 to be send to the outdoor heat exchanger 14, and the high-pressure gas refrigerant is subjected to heat exchange with the frost adhered and is condensed to turn to high-pressure liquid refrigerant. Incidentally, during the defrosting, an outdoor fan 19 is stopped for restraining the loss of heat radiation to the outside air. Here, in the outdoor heat exchanger 14, the frost adhered melts into water and drops by the gravity. Thus, the clogging of the fins is removed, whereby the heat transfer performance of the heat exchanger can be revived. The condensed high-pressure liquid refrigerant passes through the outdoor expansion valve 15 to be sent to the indoor unit 40. Then, after being throttled by the indoor expansion valve 42, the liquid refrigerant passes through the indoor heat exchanger 41, the outdoor unit 10 and the four-way valve 13 to be sent to the compressor, so that the liquid refrigerant is again circulated in the refrigerating cycle. Incidentally, during the defrosting, the indoor fan is also controlled to be held in a fan stop state for the purpose of not generating cold air, and thus, it is designed that active heat exchange is not to be done. Therefore, all of the liquid refrigerant throttled by the indoor expansion valve 42 is not gasified in dependence on the duration of the defrosting operation, and thus, it may occur that the refrigerant is returned to the outdoor unit in the form of two phases including gas and liquid.

Further, the outdoor fan 19 will be described.

A rotational speed command is sent from the controller 61 to an outdoor fan inverter 21, and a desired electric current or voltage is sent from the outdoor fan inverter 21 to the outdoor fan motor 20, so that the outdoor fan motor 20 drivingly rotates the outdoor fan 19. Thus, the outdoor fan 19 is rotated to generate air of a proper quantity. It is to be noted that the electric current or voltage sent to the fan motor 20 is detected by a current detector or a voltage detector for the outdoor fan inverter 21 and that the controller 61 (control section) controls the outdoor fan inverter 21 to make the rotational speed of the outdoor fan motor 20 become a target rotational speed.

Figure 6:
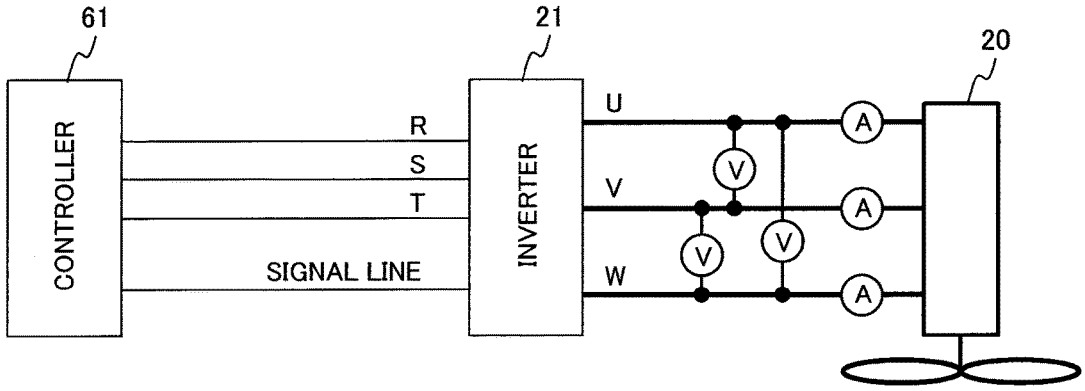
FIG. 6 shows one example in detecting electric current or voltage applied to a fan motor.

FIG. 6 shows one example in detecting the electric current or voltage applied to the fan motor 20. The electric power supplied from the controller 61 is sent to the outdoor fan motor 20 through the outdoor fan inverter 21. Here, the electric power sent from the controller 61 to the outdoor fan inverter 21 is referred to as inverter primary power, whereas the electric power sent from the outdoor fan inverter 21 to the outdoor fan motor 20 is referred to as inverter secondary power. In this case, the detection of electric current that increases together with frost formation is carried out by measuring electric currents passing through U, V and W phases of the inverter secondary power. Substitution may be made by detecting not the three phases but a particular phase. The detected electric currents are sent to the controller 61 through a signal line and are used for detection of frost formation. Further, the voltages between the respective phases may also be measured at the same time to measure the inverter secondary power. In that case, it is also possible to measure the electric power by using any two phases like U-W, U-V or V-W of the three phases.

Figure 7:
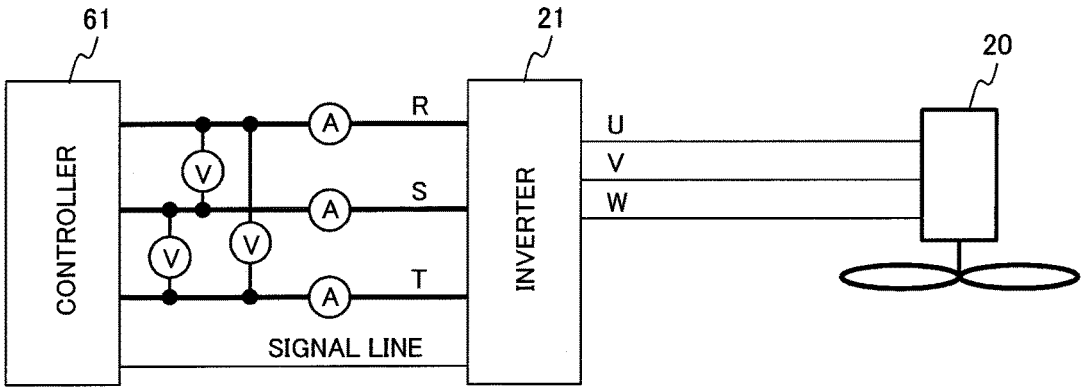
FIG. 7 shows another example in detecting electric current or voltage applied to the fan motor.

FIG. 7 shows one example in detecting electric current or voltage applied to the fan motor 20. To differ from FIG. 6, measurements are carried out for electric currents in R, S and T phases of the inverter primary power. Since one being inexpensive for general purpose is available as ammeters for a commercial power supply, the electric currents at this place may be substituted for detection of frost formation. Further, a particular phase may be detected in place of the three phases. The detected electric currents are sent to the controller 61 and are used for detection of frost formation. Further, voltages between the respective phases may be measured at the same time to measure the inverter primary voltage. In this case, it is possible to measure the electric power by using any two phases like R-T, R-S or S-T of the three phases.

Figure 2:
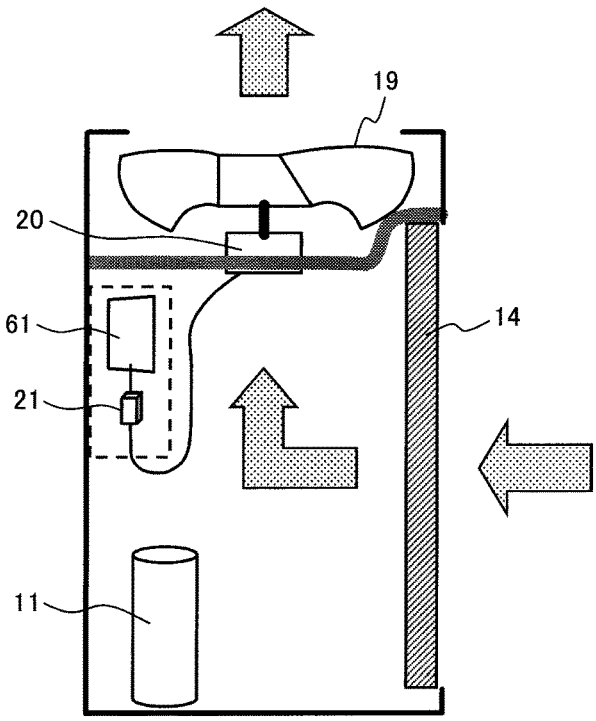
FIG. 2 shows the flow of air made by an outdoor fan in the present invention.

FIG. 2 is an illustration showing the flow of air made by the outdoor fan within the outdoor unit 10 in the present embodiment. A rotational speed command is sent from the controller 61 to the outdoor fan inverter 21, an electric current and a voltage are applied from the outdoor fan inverter 21 to the outdoor fan motor 20, and the outdoor fan 19 is rotated. Incidentally, the outdoor unit 10 in the present embodiment is illustrated as one having the outdoor fan 19 disposed at an upper part and the outdoor heat exchanger 14 arranged on the outer side at a lateral surface of the outdoor unit 10. However, the present invention is not limited to this and may be an outdoor unit provided with an outdoor far that blows in a horizontal direction.

The air passing through the outdoor heat exchanger 14 flows in a direction toward the outdoor fan 19 and finally flows out toward the downstream side (in the upper direction in FIG. 2) of the outdoor fan 19. Here, when frost formation takes place on the outdoor heat exchanger 14, resistance increases against the flow of air. Then, the present inventors found that because the outdoor unit in the present embodiment is controlled to keep the fan rotational speed of the outdoor fan 19 fixed, the fan electric current or the fan electric power increases by the equivalence of the resistance.

Figure 3:
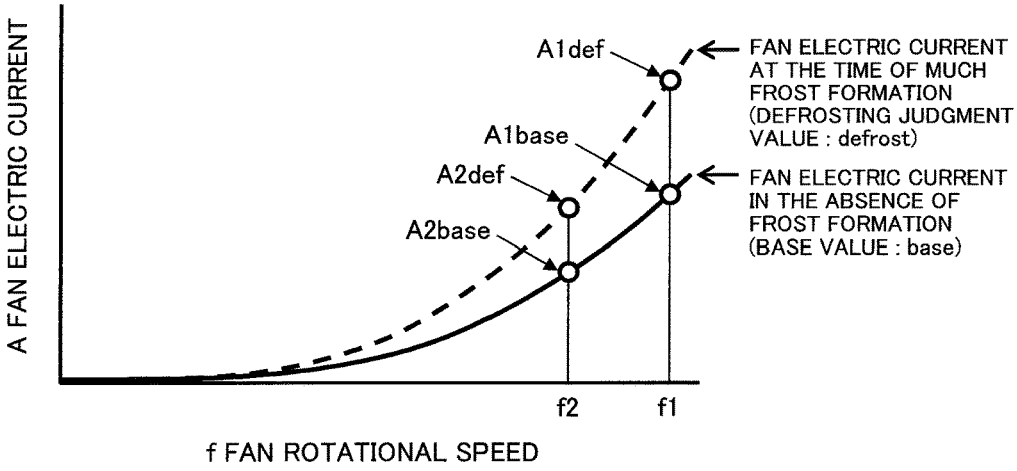
FIG. 3 shows one example of a relation between fan rotational speed and fan electric current.

FIG. 3 shows one example of a relation between the fan rotational speed and the fan electric current. The solid line represents the fan electric current in the absence of frost formation and has a characteristic that the fan electric current also increases with an increase in the fan rotational speed. Further, the broken line represents the fan electric current in the case of frost formation being very large in amount. Like this, it can be grasped that the fan electric current in the state of the frost formation increases in current value in comparison with the fan electric current in the absence of frost formation. Because the heat exchanger remarkably goes down in performance due to excessive frost formation when the fan electric current increases beyond the value specified by the broken line, it can be judged that defrosting is necessary to be performed. In short, in the present embodiment, the fan electric current specified by the broken line for much frost formation is defined as a set value at which the start of defrosting is necessary (hereafter referred to as defrosting judgment value), while the fan electric current specified by the solid line in the absence of frost formation is defined as a set value at which defrosting is unnecessary (hereafter referred to as base value).

Judgments for frost formation and defrosting will be described specifically. In the present embodiment, the control section (controller 61) controls the air conditioner to start a defrosting operation of the outdoor heat exchanger 14 based on a detection value of the current detector in the heating operation. When the fan rotational speed is f1, frost formation is absent at the early stage of the heating operation, and thus, the detection value A1 of the current detector becomes equivalent to the base value of the fan electric current (A1≈A1base). As the frost formation proceeds, the fan electric current (the detection value of the current detector) increases, and when the fan electric current (the detection value of the current detector) goes beyond the defrosting judgment value (A1≥A1def), the control section (controller 61) judges that the amount of the frost formation has increased, and starts a defrosting operation of the outdoor heat exchanger 14.

After the defrosting operation, the heating operation is started again, and then, the fan electric current (the detection value of the current detector) becomes equivalent to the base value of the fan electric current (A1≈A1base). Incidentally, the base value of the fan electric current may be stored in a storage unit of the control section (controller 61) in advance or the fan electric current upon completion of the defrosting may be replaced as the base value of the fan electric current. Furthermore, the defrosting judgment value of the fan electric current may be stored in the storage unit of the control section (controller 61) in advance or may be calculated as an increase rate relative to the base value as expressed in Expression (1).

$$A1\text{def}=K1\times A1\text{base} \quad (1)$$

K1: current increase rate

Here, if the fan rotational speed were reduced from f1 to f2 with the base value and the defrosting judgment value held as they are, the fan electric current at the early stage would become smaller than the base value of the fan electric current (A2<A1base). Even if the fan electric current increased as the frost formation further proceeds, the fan electric current would be a current equivalent to the base value (A2≈A1base) and would not reach the defrosting judgment value (A2<A1def), and thus, the defrosting operation would not begin.

For the purpose of preventing the occurrence of such a situation, there are given a base value (A2base) and a defrosting judgment value (A2def) which correspond to the rotational speed when the same changes. That is, in the present embodiment, the defrosting judgment value of the fan current (the detection value of the current detector) is set to become larger as the rotational speed of the outdoor fan 19 increases.

In further detailed description, as shown in FIG. 3, a first base value (A1base) and a second base value (A2base) being smaller than the first base value (A1base) are set as base values for the state of frost formation being absent in correspondence with a first rotational speed (f1) of the outdoor fan motor 20 and a second rotational speed (f2) being smaller than the first rotational speed (f1), respectively. Further, a first defrosting judgment value (A1def) being larger than the first base value (A1base) is set as a defrosting judgment value in the frost formation state in correspondence with the first rotational speed (f1) of the outdoor fan motor 20, and further, a second defrosting judgment value (A2def) being larger than the second base value (A2base) and being smaller than the first defrosting judgment value (A1def) is set as the defrosting judgment value in the frost formation state in correspondence with the second rotational speed (f2) of the outdoor fan motor 20.

Then, in the heating operation, the control section (controller 61) starts a defrosting operation of the outdoor heat exchanger 14 when the rotational speed of the outdoor fan motor 20 is the first rotational speed (f1) and when the detection value of the current detector becomes equal to or higher than the first defrosting judgment value (A1def), and also starts the defrosting operation of the outdoor heat exchanger 14 when the rotational speed of the outdoor fan motor 20 is the second rotational speed (f2) and when the detection value of the current detector becomes equal to or higher than the second defrosting judgment value (A2def).

Where the outdoor fan 19 is placed under a step control, base values and defrosting judgment values of the fan electric current (detection value of the current detector) that correspond to respective steps may beforehand be stored in the storage unit of the control section (controller 61). Further, since the rotational speed is continuously changed under the inverter control, the base values and the defrosting judgment values, if stored in the storage unit of the control section (controller 61) for respective rotational speeds, would cause a problem in storage capacity and therefore, may be calculated by using Expressions (2) and (3) shown below.

$$A2\text{base}=A1\text{base}\times(f2/f1)^n \quad (2)$$

n: exponential multiplier $$A2\text{def}=K2\times A2\text{base} \quad (3)$$

K: current increase rate

The base value may be obtained through conversion under the idea that it is proportional to the exponential multiplier of the rotational speed change rate like Expression (2). Further, the defrosting judgment value may be obtained by effecting a conversion to multiply the base vale with the current increase rate like Expression (3). That is, in the present embodiment, a storage unit is provided that stores the first base value (A1base), another value, that is, the second base value (A2base), the first defrosting judgment value (A 1def) or the second defrosting judgment value (A2def) can be calculated based on the base value (e.g., A1base) stored in the storage unit and the rotational speeds (f1, f2 ) of the outdoor fan motor 20, as expressed in Expression (2) and Expression (3). Regarding the current increase rate K2, in the case of the step control of the outdoor fan, those values corresponding to respective steps may beforehand be stored in the storage unit of the control section (controller 61).

Here, since the rotational speed is continuously changed under the inverter control, a problem would arise in storage capacity if the current increase rates K2 for respective rotational speeds were stored in the storage unit of the control section (controller 61). Therefore, by considering the current increase rate K2 of Expression (3) as being almost equal to the current increase rate K1 of Expression (1) (K2≈K1), the same current increase rate K1 may be used. By so doing, the storage capacity of the controller can be relieved from being burdened.

Incidentally, in Expression (2) of Embodiment 1, the second base value (A2base) and the second defrosting judgment value (A2def) are calculated by compensating the first base value (A1base) for the rotational speed, and the detection for the frost formation is made by the comparison of the current value A2 during the heating operation with the second defrosting judgment value (A2def). Alternatively, without compensating the first base value (A1base) for the rotational speed, the detection for the frost formation may be made by the comparison between the first base value (A1base) and a compensated A2 into which the value A2 during the heating operation is compensated by being compensated for the rotational speed as expressed in Expression (4).

$$\text{Compensated } A2 = A2 \times (f1/f2)^n \quad (4)$$

Embodiment 2

Hereafter, a second embodiment of the air conditioner according to the present invention will be described with reference to the drawings. Description will be omitted of the same configuration as the embodiment.

Figure 4:
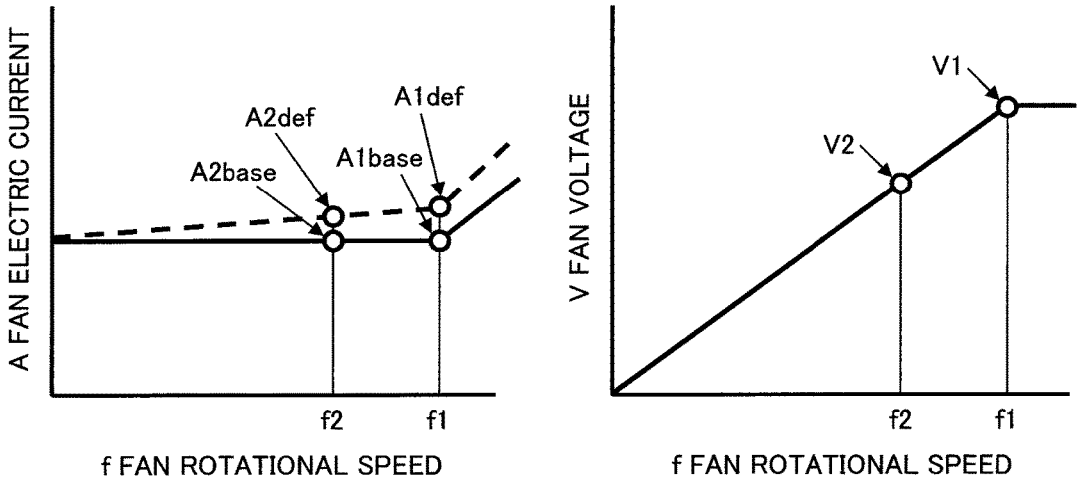
FIG. 4 shows another example of a relation between fan rotational speed and fan electric current and also to show one example of a relation between fan rotational speed and fan voltage.

The left graph in FIG. 4 shows one example of a relation between fan rotational speed and fan electric current. Further, the right graph shows one example of a relation between fan rotational speed and fan voltage. Now, let the right graph be described first. A characteristic of the control is shown under which the fan rotational speed is adjusted by voltage, and an example is exemplified wherein the fan voltage is lowered from V1 to V2 to decrease the fan rotational speed from f1 to f2. The voltage characteristic like this does not depend on the presence/absence of frost formation, and thus, the characteristic expression therefor is one only. Next, let the left graph be described. A characteristic for the case of implementing a constant torque control is shown, in which case electric current does not necessarily correspond to the change of the fan rotational speed. Where the fan rotational speed is decreased from f1 to f2, the fan electric current in the state of frost formation being absent hardly goes down (A1base≈A2base).

On the other hand, when frost formation takes place, the fan electric current becomes large at a high rotational speed, and the defrosting judgment value also becomes large at the high rotational speed (A1def>A2def). Thus, the current increase rate K2 of Expression (3) and the current increase rate K1 of Expression (1) described in Embodiment 1 do not become equal, wherein one at the high rotational speed becomes large (K2<K1). Although in this situation, it is required to have values for respective fan rotational speeds and to have the values stored in the storage unit of the control section (controller 61) in advance, there is a limit to the storage capacity. Further, since a characteristic like that in Embodiment 1 aforementioned is shown in a range higher than the fan rotational speed f1, one whose characteristic changes in a mid course is hard to be used in defrosting judgment.

Figure 5:
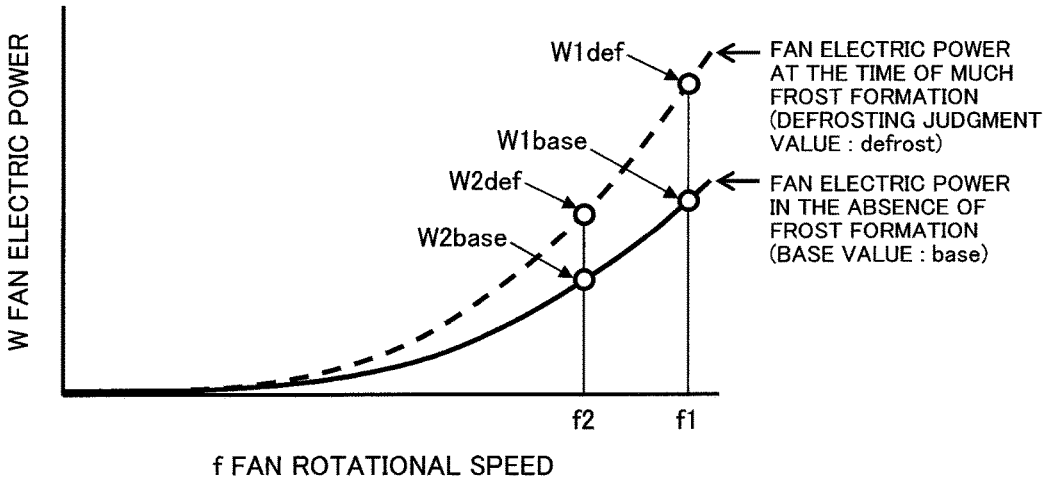
FIG. 5 shows one example of a relation between fan rotational speed and fan voltage.

FIG. 5 shows one example of a relation between the fan rotational speed and the fan electric power, and this characteristic is also attained where the constant torque control is implemented as having been described in FIG. 4. As means for solving the difficulty in judging the defrosting based on the fan electric current, the present inventors found out that the defrosting judgment is possible by the judgment based on the fan electric power. Here, although electric power ∝ electric current×voltage holds true wherein the voltage changes under the frequency control and wherein a change in current due to frost formation is difficult to come out, a change due to frost formation comes out in the fan electric power, so that it becomes possible to detect the frost formation and to make the defrosting judgment.

The solid line shows the fan electric power in the absence of frost formation and has a characteristic that the fan electric power also increases as the fan rotational speed increases. Further, the broken line shows the fan electric power in the case where the amount of the frost formation is very large. In comparison with the fan electric power in the absence of frost formation, it can be grasped that the value of the electric power increases. When the fan electric power increases beyond the value specified by the broken line, the performance of the heat exchanger goes down remarkably due to excessive frost formation, and thus, the implementation of the defrosting becomes necessary. In the present embodiment, the fan electric power indicated by the broken line at the time of excessive frost formation is defined as a defrosting judgment value at which a start of defrosting is necessary, while the fan electric power indicated by the solid line in the absence of frost formation is defined as a base value that makes the defrosting unnecessary.

Frost formation and defrosting judgments will be described specifically. In the present embodiment, the control section (controller 61) controls the air conditioner to start the defrosting operation of the outdoor heat exchanger 14 when the electric power (fan electric power) calculated based on the detection values of the current detector and the voltage detector during the heating operation becomes equal to or higher than the defrosting judgment value. Here, when the fan rotational speed is f1, the frost formation is absent at the early stage of the heating operation, and thus, the electric power value (fan electric power) calculated based on the detection values of the current detector and the voltage detector becomes equivalent to the base value of the fan electric power (W1≈W1base).

The fan electric power increases as the frost formation proceeds, and when the electric power value (fan electric power) calculated based on the detection values of the current detector and the voltage detector becomes equal to or higher than the defrosting judgment value (W1≥W1def), the control section (controller 61) judges that the frost formation amount has increased, and starts the defrosting operation of the outdoor heat exchanger 14.

After this defrosting operation, the heating operation is started again, and thus, the electric power value (fan electric power) calculated based on the detection values of the current detector and the voltage detector becomes equivalent to the base value of the fan electric power (W1≈W1base). Incidentally, the base value of the fan electric power may beforehand be stored in the storage unit of the control section (controller 61). Alternatively, the fan electric power upon completion of the defrosting may be replaced as the base value of the fan electric power. Furthermore, the defrosting judgment value of the fan electric power may beforehand be stored in the storage unit of the control section (controller 61) or may be calculated in terms of an increase rate relative to the base value as expressed by Expression (5).

$$W1\text{def}=L1\times W1\text{base} \quad (5)$$

L1: electric power increase rate

If the fan rotational speed were decreased from f1 to f2 with the base value and the defrosting judgment value held as they are, the base value of the fan electric power at the early stage of the heating operation would become smaller (W2<W1base). Even if the fan electric power increased as the frost formation further proceeds, the fan electric power would be the power that is equivalent to the base value (W2≈W1base) and lower than the defrosting judgment value (W2<W1def), whereby the defrosting could not be performed.

In order to prevent such a situation from arising, it is designed that where the rotational speed is changed, a base value (W2base) and a defrosting judgment value (W2def) are given in correspondence with the changed rotational speed. Here, in the present embodiment, a set value of the fan electric power for the defrosting judgment (electric power value calculated based on the detection values of the current detector and the voltage detector) is set to become larger as the rotational speed of the outdoor fan 19 increases.

Where the outdoor fan 19 is placed under the step control, values corresponding to respective steps may beforehand be stored in the storage unit of the control section (controller 61). Further, since the rotational speed is continuously changed under the inverter control, a problem would arise in storage capacity if the values for respective rotational speeds were stored in the storage unit of the control section (controller 61). Therefore, the values may be calculated by using Expressions (6) and (7) shown below.

$$W2\text{base}=W1\text{base}\times(f2/f1)^n \quad (6)$$

n: exponential multiplier $$W2\text{def}=L2\times W2\text{base} \quad (7)$$

L2: electric power increase rate

The base value may be obtained through conversion under the idea that it is proportional to the exponential multiplier of the rotational speed change rate as expressed in Expression (6). Further, the defrosting judgment value may be obtained by effecting a conversion to multiply the base vale with the electric power increase rate like Expression (7). Regarding the electric power increase rate L2, where the outdoor fan is placed under the step control, values corresponding to respective steps may beforehand be stored in the storage unit of the control section (controller 61). Since the rotational speed is continuously changed under the inverter control, a problem would arise in storage capacity if the values for respective rotational speeds were stored in the storage unit of the control section (controller 61). Therefore, by considering the electric power increase rate L2 of Expression (7) and the electric power increase rate L1 of Expression (5) as being almost equal (L2≈L1), the same rate L1 may be used. By so doing, the storage capacity of the controller can be relieved from being burdened. The control that starts the defrosting operation of the control section (controller 61) based on these values are the same as that in Embodiment 1 and hence, is omitted from being described in detail.

Incidentally, in Embodiment 2, although the base value and the defrosting judgment value are compensated for the rotational speed, there may be taken a method in which the detected current value is compensated for the rotational speed without compensation on the base value and the defrosting judgment value.

REFERENCE SIGNS LIST

10 Outdoor unit
11 Compressor
13 Four-way valve
14 Outdoor heat exchanger
15 Outdoor expansion value
19 Outdoor fan
20 Outdoor fan motor
21 Outdoor fan inverter
40 Indoor unit
41 Indoor heat exchanger
42 Indoor expansion value
61 Controller (control section)

The invention claimed is:

1. An air conditioner comprising:

an outdoor heat exchanger that performs heat exchange between refrigerant flowing through an interior thereof and air;

an outdoor fan that sends air to the outdoor heat exchanger;

an outdoor fan motor that drivingly rotates the outdoor fan;

an outdoor fan inverter that makes a desired electric current flow through the outdoor fan motor;

a current detector that detects an electric current flowing through the outdoor fan motor;

a voltage detector that detects a voltage applied to the outdoor fan motor;

an electric power detector that detects an electric power through conversion based on the electric current and the voltage applied to the outdoor fan motor; and a controller configured to:

control the outdoor fan inverter so that the rotational speed of the outdoor fan motor becomes a target rotational speed, start a defrosting operation of the outdoor heat exchanger when the detection value of the electric power detector becomes equal to or higher than a defrosting determination set value in the heating operation, and increase the defrosting determination set value according to an increase in the rotational speed of the outdoor fan.

2. The air conditioner according to claim 1, wherein the controller:

stores a reference set value of electric power of the outdoor fan motor in an absence of frost on the outdoor heat exchanger, which increases as the rotational speed of the outdoor fan increases, wherein the defrosting determination set value is larger than the reference set value and the difference between the defrosting determination set value and the corresponding respective reference set value increases as the rotational speed of the outdoor fan increases.

3. The air conditioner according to claim 2, wherein:

the controller:

stores a first reference set value and a second reference set value that is smaller than the first reference set value, that correspond to a first rotation speed of the outdoor fan motor and a second rotation speed that is smaller than the first rotation speed, respectively, stores a first defrosting determination set value which is larger than the first reference set value corresponding to the first rotational speed of the outdoor fan motor, the first defrosting determination set value is a predetermined value determined in a state of frost formation on the outdoor heat exchanger, stores a second defrosting determination set value which is larger than the second reference set value and smaller than the first defrost determination set value that corresponds to the second rotational speed of the outdoor fan motor, the second defrosting determination set value is a predetermined value determined in a state of frost formation on the outdoor heat exchanger, starts the defrosting operation of the exchanger upon determining the detected electric power value of the electric power detector is equal to or higher than the first defrosting determination set value when the rotational speed of the outdoor fan motor is the first rotational speed during the heating operation, and starts the defrosting operation of the exchanger upon determining the detected electric power value of the electric power detector is equal to or higher than the second defrosting determination set value when the rotational speed of the outdoor fan motor is the second rotational speed during the heating operation.

4. The air conditioner according to claim 3, wherein:

the controller:

calculates the first defrosting determination set value based on the first reference set value and the detected electric power value of the power detector, calculates the second reference set value based on the first reference set value and the rotational speed of the outdoor fan motor, and the second defrosting determination set value based on the second reference set value and the detected electric power value of the electric power detector.

* * * * *